US012765744B2

(12) United States Patent
Liao et al.

(10) Patent No.: US 12,765,744 B2
(45) Date of Patent: Oct. 20, 2026

(54) DISHWASHER

(71) Applicant: FOSHAN SHUNDE MIDEA WASHING APPLIANCES MANUFACTURING CO., LTD., Foshan (CN)

(72) Inventors: Junzhi Liao, Foshan (CN); Pingping Xu, Foshan (CN); Jiawei Han, Foshan (CN); Jianxun Zhao, Foshan (CN); Jie Shen, Foshan (CN)

(73) Assignee: FOSHAN SHUNDE MIDEA WASHING APPLIANCES MANUFACTURING CO., LTD., Foshan (CN)

( * ) Notice: Subject to any disclaimer, the term of this patent is extended or adjusted under 35 U.S.C. 154(b) by 28 days.

(21) Appl. No.: 18/820,080

(22) Filed: Aug. 29, 2024

(65) Prior Publication Data

US 2024/0415365 A1 Dec. 19, 2024

Related U.S. Application Data

(63) Continuation of application No. 17/970,985, filed on Oct. 21, 2022, now Pat. No. 12,102,280, which is a (Continued)

(30) Foreign Application Priority Data

Apr. 21, 2020 (CN) ..... 202020610489.5

(51) Int. Cl.
*A47L 15/42* (2006.01)

(52) U.S. Cl.
CPC ..... *A47L 15/4263* (2013.01)

(58) Field of Classification Search
CPC ..... A47L 15/4263
See application file for complete search history.

(56) References Cited

U.S. PATENT DOCUMENTS 3,443,719 A * 5/1969 Duncan ..... F16J 15/00 220/378
4,998,550 A 3/1991 Archambault
(Continued)

FOREIGN PATENT DOCUMENTS

CN 101584569 A 11/2009
CN 101947093 B 8/2012
(Continued)

OTHER PUBLICATIONS

European search report dated Dec. 13, 2024 received in European Patent Application No. 24195614.3.
(Continued)

*Primary Examiner* — Matthew W Ing
(74) *Attorney, Agent, or Firm* — Scully, Scott, Murphy & Presser, P.C.

(57) ABSTRACT

A dishwasher is provided. The dishwasher has an inner container, a frame and a door body. The inner container has an accommodation cavity. The accommodation cavity has a forward-facing opening. The frame is connected to an outer surface of the inner container and extends along an edge of the opening of the accommodation cavity. A sealing groove is defined in the frame. Alternatively, the sealing groove is defined by enclosing the frame and the edge of the opening of the inner container. A sealing strip is disposed in the sealing groove. A door body is configured to open or close the opening of the accommodation cavity. The door body abuts against the sealing strip in response to the opening of the accommodation cavity being covered by the door body.

15 Claims, 6 Drawing Sheets

Related U.S. Application Data continuation of application No. PCT/CN2021/085092, filed on Apr. 1, 2021.

(56) References Cited

U.S. PATENT DOCUMENTS

| | | | | |
|---|---|---|---|---|
| 2006/0283482 | A1 | 12/2006 | Berends et al. | |
| 2009/0288690 | A1 | 11/2009 | Haeberle | |
| 2017/0275927 | A1* | 9/2017 | Park | E05B 17/22 |
| 2020/0260931 | A1* | 8/2020 | Mazzaro | F16J 15/125 |
| 2022/0183535 | A1 | 6/2022 | Lee | |

FOREIGN PATENT DOCUMENTS

| | | | | |
|---|---|---|---|---|
| CN | 109171586 | A | 1/2019 | |
| CN | 209074491 | U | 7/2019 | |
| CN | 209331980 | U | 9/2019 | |
| CN | 212307758 | U | 1/2021 | |
| CN | 212307768 | U | 1/2021 | |
| DE | 102011003821 | A1 * | 8/2012 | A47L 15/4263 |
| KR | 19990048172 | A | 7/1999 | |

OTHER PUBLICATIONS

International Search Report dated Jul. 2, 2021 received in International Application No. PCT/CN2021/085092.

Notice of Reasons for Refusal dated Oct. 3, 2023 received in Japanese Patent Application No. JP 2022-564639.

Supplementary European Search Report dated Oct. 4, 2023 received in European Patent Application No. EP 21792659.1.

Notice of Allowance dated Jun. 13, 2024 received in U.S. Appl. No. 17/970,985.

Office Action dated Feb. 14, 2024 received in U.S. Appl. No. 17/970,985.

Decision to Grant a Patent dated Dec. 5, 2023 received in Japanese Patent Application No. JP 2022-564639.

Request for the Submission of an Opinion dated Jan. 9, 2024 received in Korean Patent Application No. KR 10-2022-7040671.

Written Opinion of the International Searching Authority dated Jul. 2, 2021 received in International Application No. PCT/CN2021/085092.

Request for the Submission of an Opinion dated Apr. 9, 2026 received in Korean Patent Application No. 10-2024-7027639.

* cited by examiner

DISHWASHER

CROSS-REFERENCE TO RELATED APPLICATIONS

This application is a continuation of U.S. application Ser. No. 17/970,985, filed on Oct. 21, 2022, which is a continuation application of PCT International Application No. PCT/CN2021/085092, filed on Apr. 1, 2021, which claims priority to Chinese Patent Application No. 202020610489.5 filed on Apr. 21, 2020, the entire disclosure of each of which are incorporated herein by reference in their entirety for all purposes. No new matter has been introduced.

FIELD

The present disclosure relates to the field of kitchen appliance technologies, and in particular, to a dishwasher.

BACKGROUND

Dishwashers are kitchen appliances for automatically cleaning tableware with ever-growing need for more and more ordinary families. Generally, a door body and an inner container of a dishwasher are sealed and engaged by a sealing structure. For a traditional dishwasher, the sealing structure around an opening of the inner container is formed by bending an edge of the opening of the inner container, which complicates the inner container in shape, results in high processing difficulty, and lowers production efficiency.

SUMMARY

An object of the present disclosure is to provide a dishwasher, which aims to solve at least a technical problem of simplifying an inner container structure of a dishwasher.

In order to realize the above purpose, the dishwasher according to the present disclosure includes: an inner container having an accommodation cavity, the accommodation cavity having an opening facing forward; a frame connected to an outer surface of the inner container and extending along an edge of the opening of the accommodation cavity, a sealing groove being defined in the frame, or the sealing groove being defined by enclosing the frame and the edge of the opening of the inner container, and a sealing strip being disposed in the sealing groove; and a door body configured to open or close the opening of the accommodation cavity, the door body abutting against the sealing strip in response to the opening of the accommodation cavity being covered by the door body.

In one embodiment, the sealing groove is directly defined in the frame and extends in a length direction of the frame.

In one embodiment, a front end of the sealing strip protrudes from the opening of the sealing groove to ensure that the door body is in effective contact with the sealing strip.

In one embodiment, the sealing strip is embedded in the sealing groove.

In one embodiment, the sealing strip is made of a foaming material.

In one embodiment, the frame includes: a supporting frame strip abutting against the outer surface of the inner container; and an engagement frame strip connected to a front side wall of the supporting frame strip and spaced apart from the outer surface of the inner container. The edge of the opening of the inner container protrudes from the front side wall of the supporting frame strip. The sealing groove is located between the fitting frame strip and the edge of the opening of the inner container.

In one embodiment, the door body includes an outer door, and an inner door arranged on an inner surface of the outer door. When the opening of the accommodation cavity is closed by the door body, the inner door abuts against the sealing strip.

In one embodiment, a periphery of the inner door abuts against the sealing strip; and a front side wall of the fitting frame strip protrudes from the edge of the opening of the inner container.

In one embodiment, when the inner door abuts against the sealing strip, a part of the fitting frame strip protruding from the opening of the tub is arranged around a peripheral side of the inner door.

In one embodiment, an abutting rib is disposed on and protrudes from an end, facing away from the sealing groove, of a front side wall of the fitting frame strip, a front end of the abutting rib being bent outwards to form a positioning edge. The dishwasher further includes a casing with an opening facing forward. The inner container is arranged in the casing. An edge of the opening of the casing abuts against the positioning edge.

In one embodiment, the frame is detachably connected to the inner container.

In one embodiment, a side wall of the inner container has a through hole. The supporting frame strip has a fixing hole corresponding to the through hole. The through hole and the fixing hole are connected to each other by a fastener.

In one embodiment, the edge of the opening of the inner container is bent backwards to form a reinforcement flange.

In one embodiment, the frame has a lock configured to lock or unlock the door body.

In one embodiment, the frame is configured as a plastic frame.

According to the dishwasher of the present disclosure, the frame is arranged at the edge of the opening of the inner container to enable the frame to form the sealing groove by the frame or form the sealing groove by enclosing the frame and the side wall of the inner container. Further, the sealing strip is disposed in the sealing groove. Therefore, when the opening of the accommodation cavity is closed by the door body, the door body may abut against the sealing strip to realize a sealing engagement between the door body and the inner container. The sealing groove is formed by the frame or is formed by enclosing the frame and the inner container. Therefore, a structure of the inner container may be effectively simplified to reduce production difficulty and improve processing efficiency.

BRIEF DESCRIPTION OF THE DRAWINGS

In order to clearly explain technical solutions of certain the embodiments of the present disclosure or in the related art, accompanying drawings used in the description of these embodiments or the related art are briefly described below. Obviously, the accompanying drawings as described below are merely some embodiments of the present disclosure. Based on structures illustrated in these drawings, other accompanying drawings may be obtained by those of ordinary skill in the art without creative effort.

DESCRIPTION OF REFERENCE NUMERALS

TABLE ONE

Figure 1:
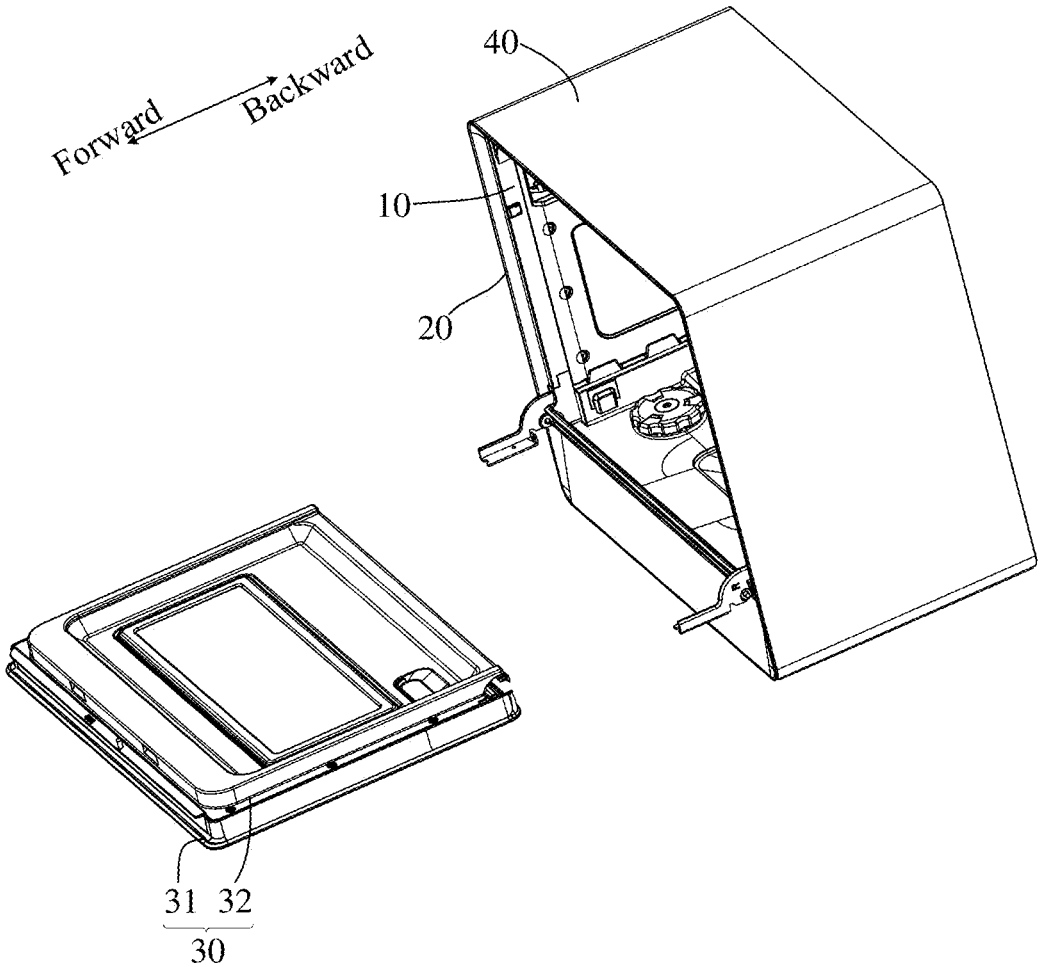
FIG. 1 is a schematic structural view of an embodiment of a dishwasher according to the present disclosure.
Figure 2:
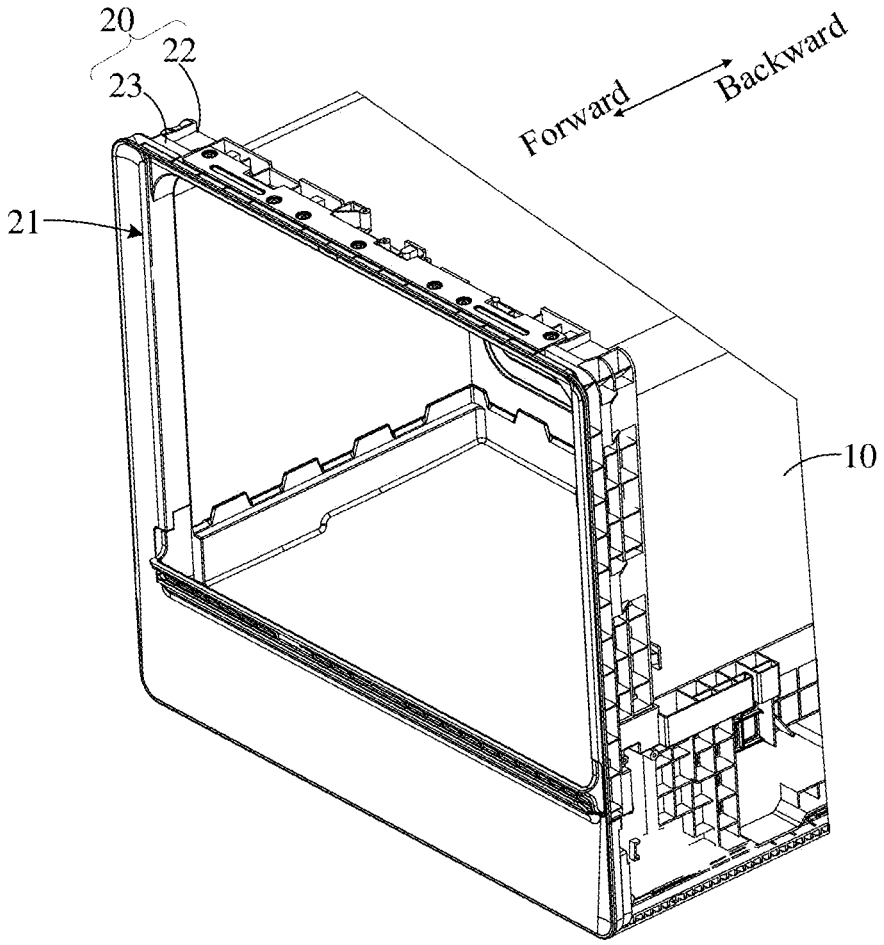
FIG. 2 is a partial schematic view of an embodiment of an inner container and a frame according to the present disclosure.
Figure 3:
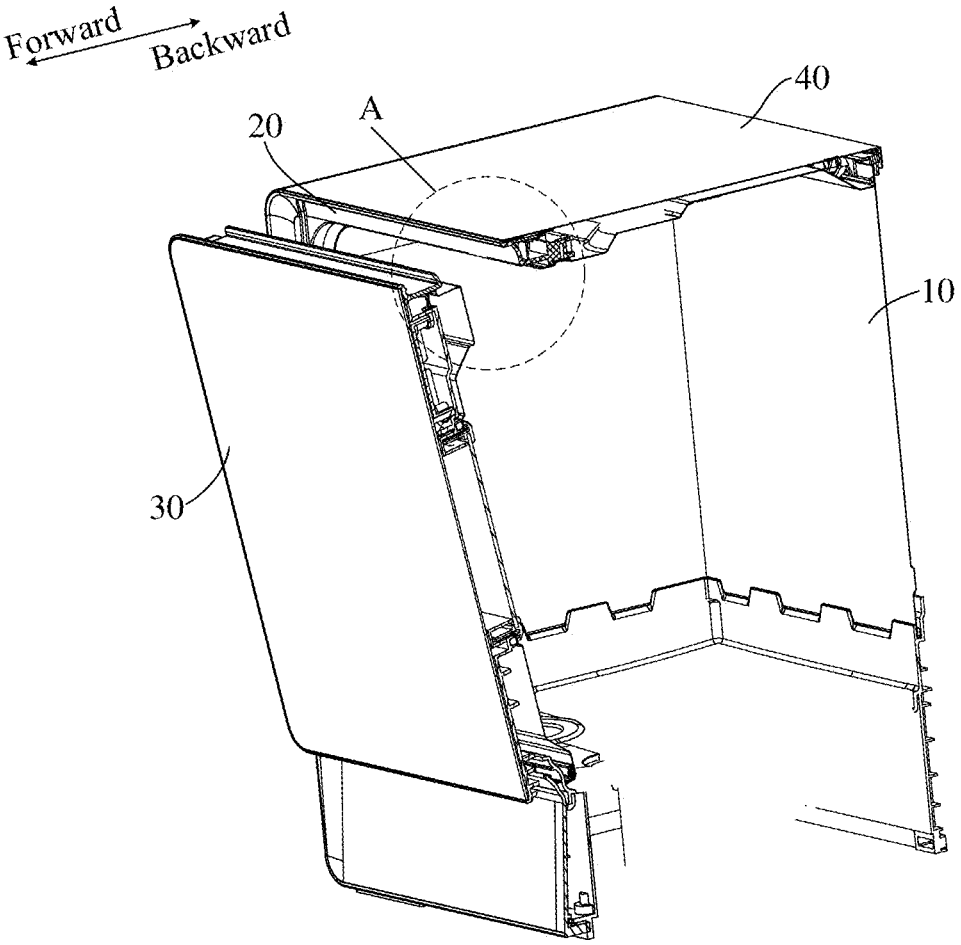
FIG. 3 is a schematic cross-sectional view of an embodiment of a dishwasher according to the present disclosure.

| Numerals | Name | Numerals | Name | Numerals | Name |
|---|---|---|---|---|---|
| 10 | inner container | 20 | frame | 21 | sealing groove |
| 30 | door body | 22 | supporting frame strip | 23 | engagement frame strip |
| 31 | outer door | 32 | inner door | 231 | abutting rib |
| 232 | positioning edge | 11 | through hole | 221 | fixing hole |
| 12 | reinforcement flange | 40 | casing | 50 | lock |

The implementation, functional characteristics, and advantages of the present disclosure will be further described with reference to the drawings.

DETAILED DESCRIPTION

Reference will be made clearly and completely to technical solutions in certain embodiments of the present disclosure with accompanying drawings. Obviously, these embodiments described here are only part, rather than all, of the embodiments of the present disclosure. Based on these embodiments of the present disclosure, other embodiments obtained by those of ordinary skill in the art without creative labor are within the scope of the present disclosure.

It should be noted that the technical solutions between the various embodiments may be combined with each other, but must be based on those of ordinary skill in the art being capable of realizing it. When the combination of the technical solutions is contradictory or cannot be implemented, it should be considered that the combination of the technical solutions does not exist, nor is within the scope of the present disclosure.

The present disclosure provides a dishwasher.

According to these embodiments of the present disclosure, as illustrated in FIG. 1 to FIG. 5, the dishwasher includes an inner container or a tub 10, a frame 20 and a door body 30. The inner container 10 has an accommodation cavity. The accommodation cavity has an opening facing forward. The frame 20 is connected to an outer surface of the inner container 10 and extends along an edge of the opening of the accommodation cavity. A sealing groove 21 is defined by the frame 20. Alternatively, the sealing groove 21 is defined by enclosing the frame 20 and the edge of the opening of the inner container 10. A sealing strip is disposed in the sealing groove 21. The door body 30 is configured to open or close the opening of the accommodation cavity. When the opening of the accommodation cavity is closed by the door body 30, the door body 30 abuts against the sealing strip.

In the embodiment, a bowl basket may be disposed in the accommodation cavity and is configured to carry tableware. In addition, a spray arm may also be disposed in the accommodation cavity to spray a fluid towards the bowl basket for cleaning the tableware. The spray arm may be disposed at both an upper part and a lower part of the bowl basket to spray the fluid in several directions. The opening of the accommodation cavity faces forward. The door body 30 is disposed on a front side of the inner container 10. It should be noted that the terms "front" and "rear" refers to a relative direction, and a side where the opening of the inner container 10 is located is defined as the front side. The door body 30 and the inner container 10 may be rotatably connected to each other. For example, a bottom of the door body 30 is rotatably connected to the inner container 10. In addition, in other embodiments, other connection manners may also be adopted between the door body 30 and the inner container 10, which is not limited in these embodiments of the present disclosure.

The frame 20 may be connected to an inner surface or the outer surface of the inner container 10, which is not limited herein. The frame 20 is located adjacent to the edge of the opening and extends in a length direction adjacent to the edge of the opening. For example, the opening is defined by three side walls. The door body 30 is rotatably connected to an edge of a bottom side wall. The frame 20 extends along edges of the three side walls. A specific structure of the frame 20 is not limited herein, as long as the sealing groove 21 may be formed by the frame 20. The sealing groove 21 may be formed by the frame 20 itself, or may be formed by enclosing the frame 20 and side walls of the inner container 10, which is not limited herein, as long as the sealing groove 21 is opened forwards. For example, the sealing groove 21 is directly defined in the frame 20 and extends in a length direction of the frame 20.

The sealing strip is embedded in the sealing groove 21. The sealing strip may be made of a foaming material to improve fitting sealing performance with the sealing groove 21 and abutting sealing performance of against the door body 30. A front end of the sealing strip may protrude from the opening of the sealing groove 21 to ensure that the door body 30 is in effective contact with the sealing strip. After the door body 30 abuts against the sealing strip, a sealing fitting between the door body 30 and the inner container 10 may be achieved to avoid fluid or air leakage during an operation of the dishwasher. The frame 20 is configured as a plastic frame to be formed by injection molding, to improve production efficiency and reduce production costs. Since production and processing of the frame 20 is simpler and more convenient than directly bending the edge of the opening of the inner container 10 to form the groove structure, a structure of the inner container 10 may be simplified through forming the sealing groove 21 by the frame 20 to improve production and processing efficiency of the dishwasher.

According to the dishwasher of the present disclosure, the frame 20 is arranged at the edge of the opening of the inner container 10 to form the sealing groove 21 by the frame 20 or form the sealing groove 21 by enclosing the frame 20 and the side walls of the inner container 10. Further, the sealing strip is disposed in the sealing groove 21. Therefore, when the opening of the accommodation cavity is closed by the door body 30, the door body 30 may abut against the sealing strip to realize the sealing fitting between the door body 30 and the inner container 10. The sealing groove 21 is formed by the frame 20 or is formed by enclosing the frame 20 and the inner container 10. Therefore, the structure of the inner container 10 can be effectively simplified to reduce production difficulty and improve processing efficiency.

It should be noted that, directional indication (such as upper, lower, left, right, front, and back, . . . ) related to these embodiments of the present disclosure is only intended to interpret a relative positional relationship and a motion situation between each component in a certain specific attitude (as illustrated in FIG. 1). When the specific attitude changes, the directional indication also changes accordingly.

Figure 4:
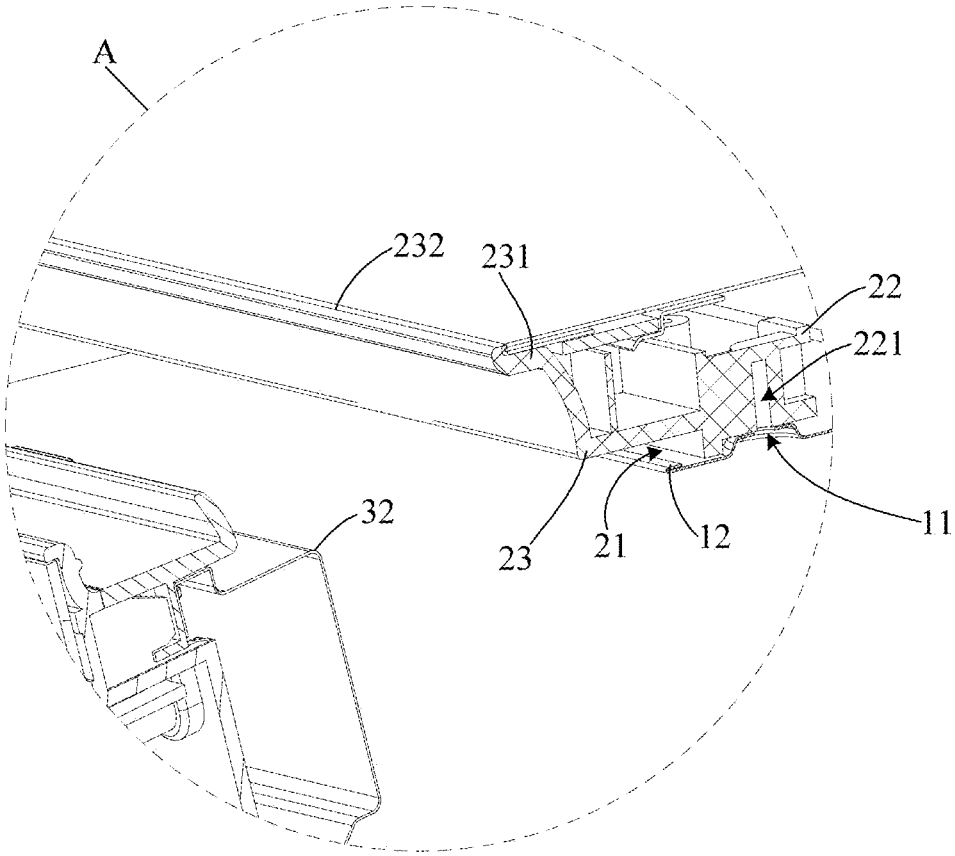
FIG. 4 is a partial enlarged view at A in FIG. 3.
Figure 5:
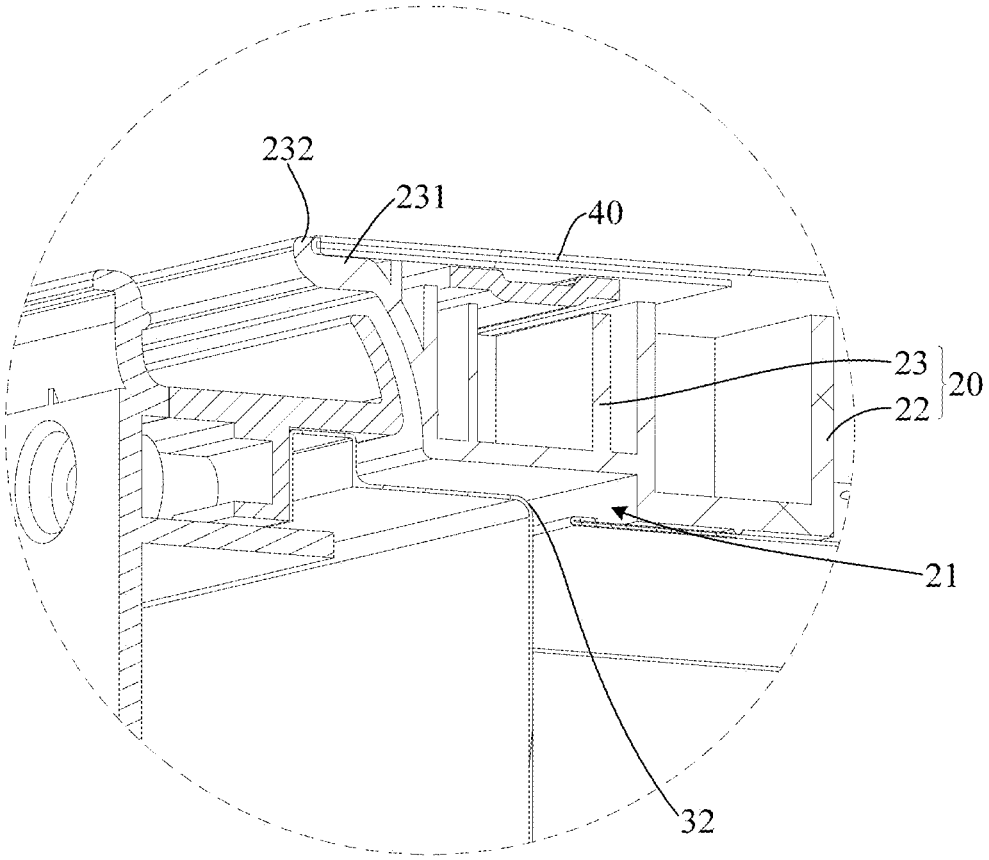
FIG. 5 is a schematic view of a door body in a closed state in FIG. 4.

In some embodiments, as illustrated in FIG. 4 and FIG. 5, the frame 20 includes a supporting frame strip 22 abutting against the outer surface of the inner container 10, and an engagement frame strip 23 connected to a front side wall of the supporting frame strip 22. The engagement frame strip 23 is spaced apart from the outer surface of the inner container 10. The edge of the opening of the inner container 10 protrudes from the front side wall of the supporting frame strip 22. The sealing groove 21 is located between the engagement frame strip 23 and the edge of the opening of the inner container 10. In this embodiment, the frame 20 is connected to the outer surface of the inner container 10, which can reduce occupation of a space of the accommodation cavity. When a frame strip is located on a top wall of the inner container 10, a bottom wall of the supporting frame strip 22 protrudes from a bottom wall of the engagement frame strip 23, and abuts against the inner container 10. The edge of the opening protrudes forwardly from the front side wall of the supporting frame strip 22 to enclose together with the bottom wall of the engagement frame strip 23 to form the sealing groove 21. The sealing groove 21 is configured to be formed by enclosing the frame 20 and the outer surface of the inner container 10, which enables a sealing portion to be closer to the inner container 10 after the sealing strip is disposed within the sealing groove 21. Therefore, it is possible to prevent the fluid sprayed to the door body 30 from flowing to the frame 20, thereby further improving the sealing performance.

In practical applications, as illustrated in FIG. 1, FIG. 4 and FIG. 5, the door body 30 includes an outer door 31, and an inner door 32 arranged on an inner surface of the outer door 31. When the opening of the accommodation cavity is closed by the door body 30, the inner door 32 abuts against the sealing strip. In the embodiment, the inner door 32 may has a frame shape. Three sides of the frame of the inner door 32 are adjacent to a top side and two vertical side of the outer door 31, respectively. In other words, the inner door 32 protrudes from a middle part of the door body 30. Therefore, it is possible to prevent the door body 30 from being normally closed when too much tableware protrudes out of the opening of the accommodation cavity. Meanwhile, it is ensured that the inner door 32 may effectively abut against the sealing strip to improve sealing stability.

In addition, as illustrated in FIG. 4 and FIG. 5, a periphery of the inner door 32 abuts against the sealing strip. A front side wall of the engagement frame strip 23 protrudes from the edge of the opening of the inner container 10. In the embodiment, when the inner door 32 abuts against the sealing strip, the engagement frame strip 23 protruding from the opening of the inner container 10 is arranged at a peripheral side of the inner door 32, to provide a hidden and protection for an abutting position between the inner door 32 and the sealing strip, and thus the sealing stability is improved.

In one embodiment, as illustrated in FIG. 4, an abutting rib 231 is disposed on, and protrudes from an end, facing away from the sealing groove 21, of a front side wall of the engagement frame strip 23. A front end of the abutting rib 231 is bent outwards to form a positioning edge 232. The dishwasher further includes a casing 40 with a forward-facing opening. The inner container 10 is arranged in the casing 40. An edge of the opening of the casing 40 abuts against the positioning edge 232. In the embodiment, the supporting frame strip 22 and the engagement frame strip 23 are located between the inner container 10 and the casing 40, which can provide supporting for the casing 40 and maintain stable shapes of the openings of the casing 40, thereby preventing collapse from occurring at the openings. The abutting rib 231 and the positioning edge 232 both extend in a length direction of the engagement frame strip 23. An inner surface of the casing 40 abuts against an outer surface of the abutting rib 231, and a front end of the opening of the casing 40 abuts against a rear surface of the positioning edge 232. In addition, an outer edge of the positioning edge 232 may be flush with an outer surface of the casing 40. Therefore, it is possible to enhance the fitting strength of the casing 40 and the frame 20, and improve integrity of the dishwasher.

In one embodiment, the frame 20 is detachably connected to the inner container 10. In the embodiment, the frame 20 is connected to the inner container 10 by the supporting frame strip 22, and the specific connection manner is not limited, as long as the frame 20 can be detachably connected to the inner container 10. For example, the frame 20 may be snapped to the inner container 10. By detachably connecting the frame 20 to the inner container 10, detachment and replacement of the frame 20 is facilitated. In some embodiments, as illustrated in FIG. 4, a through hole 11 is defined on a side wall of the inner container 10. The supporting frame strip 22 has a fixing hole 221 corresponding to the through hole 11. The through hole 11 and the fixing hole 221 are connected to each other by a fastener. In the embodiment, the inner container 10 and the frame 20 may be locked by a screw to implement the detachable connection. When detaching or mounting the frame 20, the fastener may be detached or mounted from the accommodation cavity of the inner container 10. Therefore, the frame 20 and the inner container 10 may be detached or mounted more simply and conveniently.

In practical applications, as illustrated in FIG. 4, the edge of the opening of the inner container 10 is bent backwards to form a reinforcement flange 12. In the embodiment, by the reinforcement flange 12, it is possible to improve the structural strength of the opening of the inner container 10, maintain the stable shape of the opening, and avoid collapse. Further, it is also possible to prevent users' hands from being scrapped to improve user experience.

Figure 6:
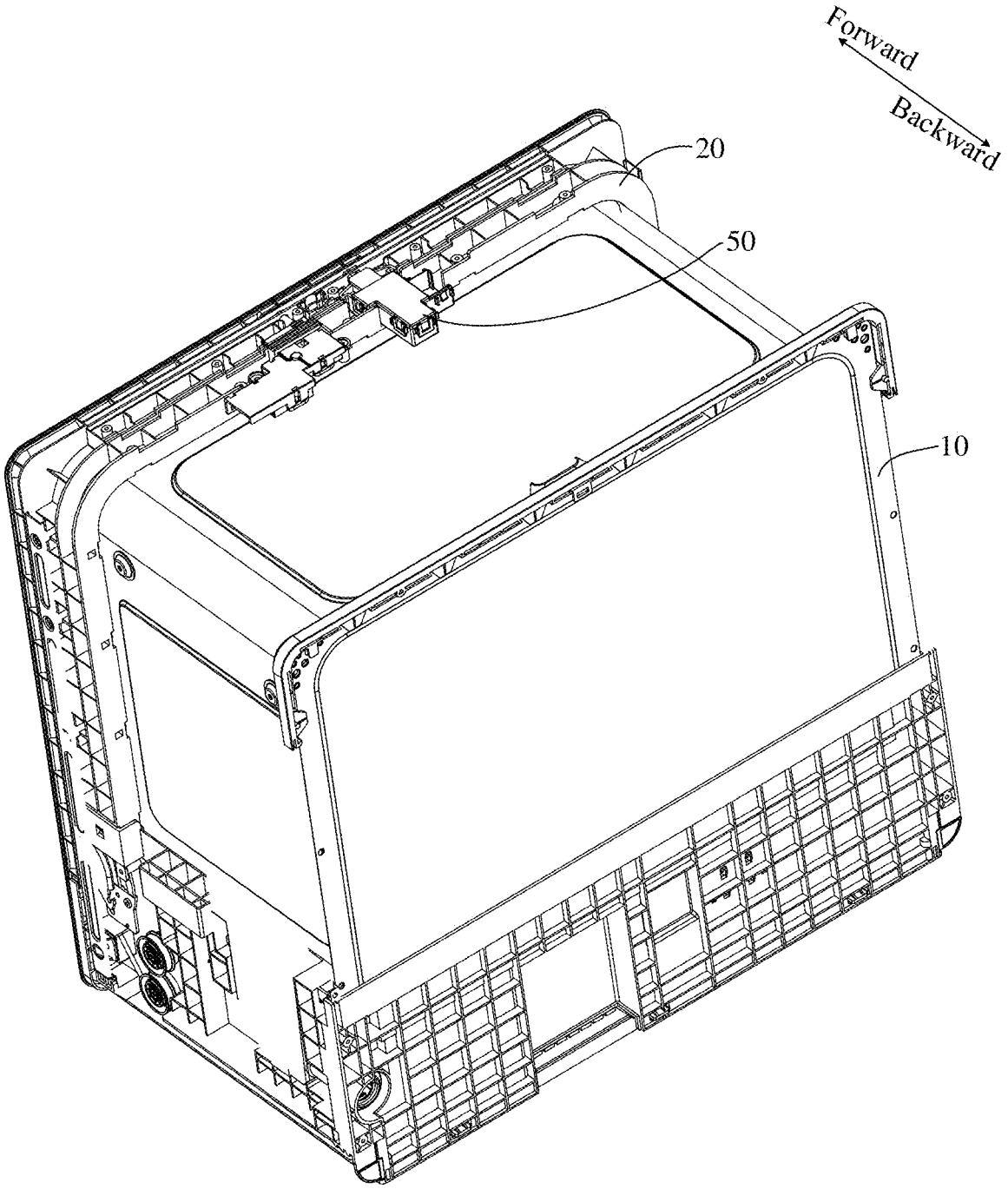
FIG. 6 is a schematic structural view of another embodiment of a dishwasher of the present disclosure.

In one embodiment, as illustrated in FIG. 6, the frame 20 has a lock 50 configured to lock or unlock the door body 30. In the embodiment, the lock 50 may be in a wax motor form. When the door body 30 is required to be opened, the wax motor is powered and heated to push the door body 30 to open the door body 30. The frame 20 may be provided with a limiting groove. The limiting groove may be a groove having a continuous and complete groove wall, or may be formed by enclosing a plurality of limiting ribs arranged at intervals. The lock 50 is at least partially disposed in the limiting groove. A part of the lock 50 disposed in the limiting groove is limited by the frame 20. The frame 20 abuts against the lock 50 and limits movements of the lock 50 in several directions to prevent separation of the lock 50 from the inner container 10. In some embodiments, when the bottom of the door body 30 is rotatably connected to the inner container 10, the lock 50 may be located above a top wall of the inner container 10 to push a top of the door body 30. Therefore, torque may be increased to enable the lock 50 to lock or unlock the door body 30 more smoothly and conveniently.

The above illustrates merely exemplary embodiments of the present disclosure, rather than being intended to limit the scope of the present disclosure. According to the inventive concept of the present disclosure, any equivalent structural modification made by using the description and accompanying drawings of the present disclosure, or directly/indirectly application in other related art, are both included within the scope of the present disclosure.

What is claimed is:

1. A dishwasher comprising:

an inner container having an accommodation cavity, the accommodation cavity having an opening facing forward;

a frame connected to an outer surface of the inner container and arranged to be located adjacent to an edge of the opening of the accommodation cavity and to extend in a length direction of the frame adjacent to the edge of the opening, wherein a sealing groove is defined in the frame and on an outer surface side of the inner container, or the sealing groove is enclosed by the frame and the outer surface of the inner container, a sealing strip disposed in the sealing groove; and a door body configured to open or cover the opening of the accommodation cavity, wherein the door body abuts against the sealing strip in response to the opening of the accommodation cavity being covered by the door body.

2. The dishwasher according to claim 1, wherein the sealing groove is directly defined in the frame and extends in the length direction of the frame.

3. The dishwasher according to claim 1, wherein a front end of the sealing strip protrudes from an opening of the sealing groove to ensure that the door body is in effective contact with the sealing strip.

4. The dishwasher according to claim 1, wherein the sealing strip is embedded in the sealing groove.

5. The dishwasher according to claim 1, wherein the sealing strip is made of a foaming material.

6. The dishwasher according to claim 1, wherein the frame comprises:

a supporting frame strip abutting against the outer surface of the inner container; and a fitting frame strip connected to a front side wall of the supporting frame strip and spaced apart from the outer surface of the inner container, wherein:

the supporting frame strip protrudes beyond a bottom wall of the fitting frame strip to abut against the outer surface of the inner container;

the edge of the opening of the accommodation cavity protrudes from the front side wall of the supporting frame strip; and the sealing groove is located between the bottom wall of the fitting frame strip and the edge of the opening of the accommodation cavity.

7. The dishwasher according to claim 6, wherein:

the door body comprises an outer door, and an inner door arranged facing an inner surface of the outer door; and when the opening of the accommodation cavity is closed by the door body, the inner door abuts against the sealing strip.

8. The dishwasher according to claim 7, wherein:

a periphery of the inner door abuts against the sealing strip; and a front side wall of the fitting frame strip protrudes from the edge of the opening of the accommodation cavity.

9. The dishwasher according to claim 8, wherein when the inner door abuts against the sealing strip, a part of the fitting frame strip protruding from the opening of the accommodation cavity is arranged around a peripheral side of the inner door.

10. The dishwasher according to claim 6, wherein:

an abutting rib is disposed on and protrudes from an end, facing away from the sealing groove, of a front side wall of the fitting frame strip, a front end of the abutting rib being bent outwards to form a positioning edge;

the positioning edge extends along a longitudinal direction of the fitting frame strip;

the dishwasher further comprises a casing with an opening facing forward;

an inner surface of the casing abuts against an outer surface of the abutting rib;

the inner container is arranged in the casing; and an edge of the opening of the casing abuts against and is flush with a rear facing surface of the positioning edge.

11. The dishwasher according to claim 6, wherein the frame is detachably connected to the inner container.

12. The dishwasher according to claim 11, wherein:

a side wall of the inner container has a through hole;

the supporting frame strip has a fixing hole corresponding to the through hole; and the through hole and the fixing hole are connected to each other by a fastener.

13. The dishwasher according to claim 1, wherein the edge of the opening of the accommodation cavity is bent backwards to form a reinforcement flange.

14. The dishwasher according to claim 1, wherein the frame has a lock configured to lock or unlock the door body.

15. The dishwasher according to claim 1, wherein the frame is configured as a plastic frame.

* * * * *